US008899692B2

(12) United States Patent
Lumb

(10) Patent No.: US 8,899,692 B2
(45) Date of Patent: Dec. 2, 2014

(54) METHOD AND APPARATUS FOR MINING A MATERIAL IN AN UNDERGROUND ENVIRONMENT

(75) Inventor: Matthew Lumb, Darlington (AU)

(73) Assignees: Hilary Leith Lumb (NZ); Norma Leith Morgan (AU); James Edward Morgan (AU)

( * ) Notice: Subject to any disclaimer, the term of this patent is extended or adjusted under 35 U.S.C. 154(b) by 599 days.

(21) Appl. No.: 12/866,233

(22) PCT Filed: Jan. 30, 2009

(86) PCT No.: PCT/AU2009/000108

§ 371 (c)(1),
(2), (4) Date: Oct. 6, 2010

(87) PCT Pub. No.: WO2009/097646

PCT Pub. Date: Aug. 13, 2009

(65) Prior Publication Data

US 2011/0018332 A1 Jan. 27, 2011

(30) Foreign Application Priority Data

Feb. 4, 2008 (AU) ..... 2008900474

(51) Int. Cl.
*E21C 41/16* (2006.01)
*E21F 13/00* (2006.01)

(52) U.S. Cl.
CPC ..... *E21C 41/16* (2013.01); *E21F 13/00* (2013.01)
USPC ..... 299/18

(58) Field of Classification Search
CPC ..... E21C 41/18; E21C 41/16
USPC ..... 299/30, 18
See application file for complete search history.

(56) References Cited

U.S. PATENT DOCUMENTS 2,859,953 A * 11/1958 Joy ..... 299/18
3,225,678 A * 12/1965 Densmore ..... 454/171

(Continued)

FOREIGN PATENT DOCUMENTS

GB 2 224 053 A 4/1990
WO 95/30067 11/1995

OTHER PUBLICATIONS

Extended European Search Report mailed Mar. 11, 2013 in Application No. 09708191.3, 7 pages.

*Primary Examiner* — John Kreck
(74) *Attorney, Agent, or Firm* — Kilpatrick Townsend & Stockton, LLP; James K. Chang, Esq.

(57) ABSTRACT

The present disclosure provides a method for mining a material in an underground environment. The method comprises positioning a structure in an underground roadway and locating the structure so that the structure provides a reactive force when a cutting head is pushed against the material via a series of members coupled to the structure. The roadway is suitable for passage of people and transportation of machinery and removed material. The method also comprises coupling the cutting head to at least one of the members of the series of members and the series of members to the structure. Further, the method comprises forming a plurality of branch tunnel portions projecting from the roadway into the material using the cutting head and the series of members coupled to the structure, comprising repositioning the cutting head and the series of members between formation of the branch tunnel portions. At least one of the formed branch tunnel portions has a length of more than 50 m.

21 Claims, 8 Drawing Sheets

(56) References Cited

U.S. PATENT DOCUMENTS

| | | | | | |
|---|---|---|---|---|---|
| 3,345,108 | A | | 10/1967 | Newman | |
| 3,897,976 | A | * | 8/1975 | Gallis | 299/56 |
| 4,021,076 | A | | 5/1977 | Hawthorne et al. | |
| 4,053,182 | A | * | 10/1977 | Nelson | 299/19 |
| 4,080,000 | A | | 3/1978 | Paurat | |
| 4,309,059 | A | | 1/1982 | Walsh | |
| 4,589,700 | A | * | 5/1986 | Schroder | 299/18 |
| 5,890,771 | A | | 4/1999 | Cass | |
| 6,460,937 | B2 | * | 10/2002 | Seear et al. | 299/18 |
| 6,817,678 | B2 | * | 11/2004 | Seear et al. | 299/64 |
| 6,851,757 | B2 | | 2/2005 | Fourie et al. | |

* cited by examiner

METHOD AND APPARATUS FOR MINING A MATERIAL IN AN UNDERGROUND ENVIRONMENT

CROSS-REFERENCES TO RELATED APPLICATIONS

This application is a National Stage of International Application No. PCT/AU2009/000108 filed Jan. 30, 2009, and which claims the benefit of Australian Patent Application No. 2008900474, filed Feb. 4, 2008, the disclosures of which are incorporated herein by reference.

FIELD OF THE INVENTION

The present invention broadly relates to method and an apparatus for mining a material in an underground environment.

BACKGROUND OF THE INVENTION

A variety of different methods are currently used to mine materials in an underground environment, such as coal in a coal seam. Typically, tunnels are formed which may include a plurality of branches that provide access to the mineral to be mined. Workers and machinery are then passing through the tunnels to mine the material. Consequently, it is necessary to secure the tunnels with roof bolts or other support elements so that the safe passage of the workers and machinery is possible. Further, the tunnels have to be of a width and height that is sufficiently large so that the workers and the machinery can pass through in a convenient manner.

Dimensions of the tunnels are also influenced by a thickness of a seam of the material, ventilation requirements, an extraction method that is used, geotechnical conditions and other conditions. Typical tunnels may have a width in the order of 5-6 m and a height of are 2-4 m.

Examples of methods for coal mining in an underground environment include "Longwall", "Board and Pillar" and to a lesser extent "Wongawilli" mining methods.

One of the largest costs in forming tunnels such as "roadways" underground is that of supporting the tunnels. Thus, a limiting factor for the economic success of most underground mines is the ratio of secured tunnel area to extractable materials. The known methods have disadvantages in this regard and there is a need for technological advancement.

SUMMARY OF THE INVENTION

The present invention provides in a first aspect a method for mining a material in an underground environment, the method comprising the steps of:

locating a structure in or adjacent an underground roadway so that the structure provides a reactive force when a cutting head is pushed against the material via a series of rigid members coupled to the structure, the underground roadway being suitable for passage of people and transportation of machinery and removed material;

positioning the cutting head and the series of rigid members so that the structure provides the reactive force when the cutting head is pushed against the material via the series of rigid members; and forming a plurality of branch tunnel portions projecting into the material.

The step of forming a plurality of branch tunnel portions typically comprises forming a first branch tunnel portion using the cutting head and the series of rigid members; and thereafter forming a second branch tunnel portion and, during formation of the second branch tunnel portion, moving rigid members from the first tunnel portion into the second branch tunnel portion to extend the series of rigid members in the second branch tunnel portion.

Moving the rigid members typically comprises moving the rigid members across the roadway.

The first and second branch tunnel portions may project from the same side of the road way. Alternatively, the first and second branch tunnel portions may project from the opposite sides of the roadway.

The first and second branch tunnel portions may be formed using first and second cutting heads, respectively.

The step of locating a structure may comprise locating first and second structures in or adjacent an underground roadway so that the first and second structures provide reactive forces when a cutting head is pushed against the material via a series of rigid members coupled to either the first or the second structure.

The step of positioning the cutting head and the series of rigid members may comprise repositioning the cutting head and the series of rigid members between formation of the branch tunnel portions.

At least one of the formed branch tunnel portions typically has a length of more than 50 m.

Each rigid member typically is a rigid beam section, such as a rigid "push beam" section, and consequently the series of rigid members typically is a series of rigid beam sections.

The method may also comprise the step of forming the underground roadway.

The material typically is mined by forming the branch tunnel portions without the need for people to pass through at least the majority of the length of the formed branch tunnel portions.

In one specific embodiment the method is conducted so that the branch tunnel portions are formed and the material is mined without penetration of people into the branch tunnel portions. Typically, only the series of rigid members, the cutting head, associated machinery and consumables are required to penetrate into the branch tunnel portions.

In one specific embodiment of the present invention at least one of the branch tunnel portions, typically all of the formed branch tunnel portions, are formed without positioning any supporting elements or bolts.

Throughout this specification, the word "bolt" (and variations thereof) is used to refer to steel members that are put in place to provide a suitable support for the surface of a tunnel, such as a roadway in the underground environment.

At least the majority of the formed branch tunnel portions typically has a length of more than 100 m, 200 m, 300 m or even more than 500 m. In one specific embodiment of the present invention all formed branch tunnel portions have a length of more than 100 m, 200 m, 300 m or even more than 500 m.

The material typically is a part of a seam of the material, such as a coal seam.

The branch tunnel portions typically are formed in a direction that is transverse to the roadway.

In one example step of forming the plurality of branch tunnel portions comprises repositioning the structure in the roadway after forming at least one branch tunnel portion so that a branch tunnel portion from another position may be formed. Further, the step of forming the plurality of branch tunnel portions typically comprises extending, retracting and repositioning the series of rigid members. In addition, the step of forming the plurality of branch tunnel portions typically comprises transporting the removed material to a remote location.

Further, the roadway from which the branch tunnel portions project may be a first roadway and the method may comprise forming a second roadway. The second roadway may be linked to a side portion of the first roadway in a manner such that the series of rigid members may be moved through a portion of the second roadway towards the first roadway and intersect the first roadway. A branch tunnel portion may then be formed in a convenient manner from the first roadway in a manner such that individual rigid members are moved across the first roadway for extending the series of rigid members that is being used to form the branch tunnel portion.

For example, the second roadway may comprise an angular portion and may be formed so that material is positioned between the first and second roadways. In one example the second roadway comprises a portion that is substantially parallel to the first roadway.

The method may also comprise removing the material between the first and second roadways typically by forming a first branch tunnel portion and then forming a second immediately adjacent parallel branch tunnel portion. The method may comprise repositioning the cutting head and at least some of the rigid members to positions that are substantially parallel a previously formed branch tunnel. Further, the method may also comprise removing the material at either side of the first roadway.

The series of rigid members may be attached to the structure either directly or indirectly via at least one element, such as a coupling element.

The method typically is conducted so that the branch tunnel portions are formed at a speed of more than 10 m, 20, 30 m or even more than 50 m per hour.

The method typically comprises forming a plurality of adjacent branch tunnel portions. The adjacent branch tunnel portions may be separated by wall portions. Alternatively, the formed adjacent branch tunnel portions may comprise at least some branch tunnel portions that are not separated by a wall portion and together form a branch tunnel portion of increased width.

The method in accordance with embodiments of the present invention has significant commercial advantages. As there is typically no need for people to access the formed branch tunnel portions, it is typically not necessary to secure the branch tunnel portions with bolts or the like, which results in a significant reduction in cost. Further, because there is typically no requirement for securing the branch tunnel portions, the average speed of advancement is significantly increased and it is possible to mine the material more efficiently. In addition, it is possible to adjust for an offset in the seam of the material simply by adjusting a direction in which one or more branch tunnel portions are formed or by forming the one or more branch tunnel portion from a slightly different level from the roadways.

The roadway may be one of a plurality of roadways that are formed and from which the branch tunnel portions are formed. For example, at least two substantially parallel roadways may be formed and the material between the at least two roadways may be removed by forming the branch tunnel portions from either one of the at least two roadways. The method may comprise forming a branch tunnel portion from one of the roadways towards an adjacent one of the roadways until the end-portion of another branch tunnel portion, which was formed from the adjacent one of the roadways, is reached. The material between the at least two adjacent roadways may be removed by forming the plurality of the branch tunnel portions from either one of the at least two adjacent roadways.

The method typically comprises extending the length of the series of rigid members. For example, the method may comprise adding rigid members to the series of rigid members and thereby extending the length of the series of rigid members.

The method may comprise conveying the removed material from an end-portion of the series of the rigid members through the roadway to a remote location. For example, the series of rigid members may comprise at least one auger that transports the removed material from the cutting head to a conveyor.

The method may also comprise forming the branch tunnel portions so that the formed branch tunnel portions project from either side of the or each roadway. For example, the method may comprise forming at least one branch tunnel portion from the roadway in a first direction, such as along a seam of the material, and then forming at least one further branch tunnel portion in a second direction that is substantially opposite the first direction.

The present invention provides in a second aspect an apparatus for mining a material in an underground environment, the apparatus comprising:

a series of rigid members having a length of more than 50 m;

a cutting head coupled to an end-portion of the series of rigid members for removing material;

a first and a second structure for positioning in or adjacent an underground roadway, the first and second structures being arranged to provide a reactive force when the cutting head is forced against the material for removal of the material via the series of rigid members coupled to either the first structure or the second structure for forming the first or a second branch tunnel portion, respectively; and a conveyor for conveying removed material to a remote location.

The apparatus typically is arranged to form a branch tunnel projecting from the roadway and having a length that corresponds approximately to the length of the series of the rigid members.

Each rigid member typically is a rigid beam section, such as a rigid "push beam" section, and consequently the series of rigid members typically is a series of rigid beam sections.

The cutting head may be arranged for removing the material from an end-portion of the branch tunnel portion by cutting material, grinding or otherwise removing the material.

The series of rigid members typically comprises rigid members that can be removed or inserted to vary the length of the series of rigid members. For example, an individual rigid member may have a length of the order of 2 m or more. The series of rigid members may have a length of more than 100 m, 200 m, 300 m or even 500 m or more.

The series of rigid members may be coupled to the structure either directly or indirectly via one or more elements.

The series of rigid members typically comprises at least one auger, typically a series of augers, for transporting the removed material from the cutting head onto a portion of the conveyor. In one specific embodiment of the present invention the at least one auger of the series of rigid members is arranged to transport the removed material to the structure positioned in the roadway and onto the conveyor at the position of the structure.

For example, the first and second structures may comprise coupling elements that may be positioned at the structures and the structures may comprise an open bottom portions positioned over the conveyor. The first and second coupling elements typically are arranged for coupling to an end-portion of the series of rigid members and may be arranged so that the removed material is received from the at least one auger of the rigid member and is directed through the open bottom portion onto the conveyor. The coupling elements may also comprise a drive for driving the at least one auger of the series of rigid members. Further, the coupling elements may be arranged for coupling the series of rigid members from at least two directions, which may be opposite to each other, so that branch tunnels in the at least two directions may be formed.

The present invention provides in a third aspect a method of mining a material from a highwall of a mine, the method comprising the steps of:

positioning a structure at the highwall, the structure being arranged for attaching a series of rigid beam sections with a cutting head and to provide a reactive force when the cutting head is forced against the material for removal of the material;

forming a first tunnel portion using the cutting head and the series of rigid beam sections attached to the structure;

retracting rigid beam sections and the cutting head from the first tunnel portion after formation of the first tunnel portion;

commencing formation of a second tunnel during retracting of the rigid beam sections and the cutting head from the first tunnel portion; and moving rigid beam sections from the first tunnel portion into the second tunnel portion during formation of the second tunnel portion.

The first and the second tunnel portions typically are substantially parallel tunnel portions.

The method typically comprises forming a plurality of tunnel portions in a manner such that formation of individual tunnel portions commences during retracting rigid beam sections and the cutting head from a previously formed tunnel portion.

The invention will be more fully understood from the following description of specific embodiments of the invention. The description is provided with reference to the accompanying drawings.

DETAILED DESCRIPTION OF SPECIFIC EMBODIMENTS

Figure 1:
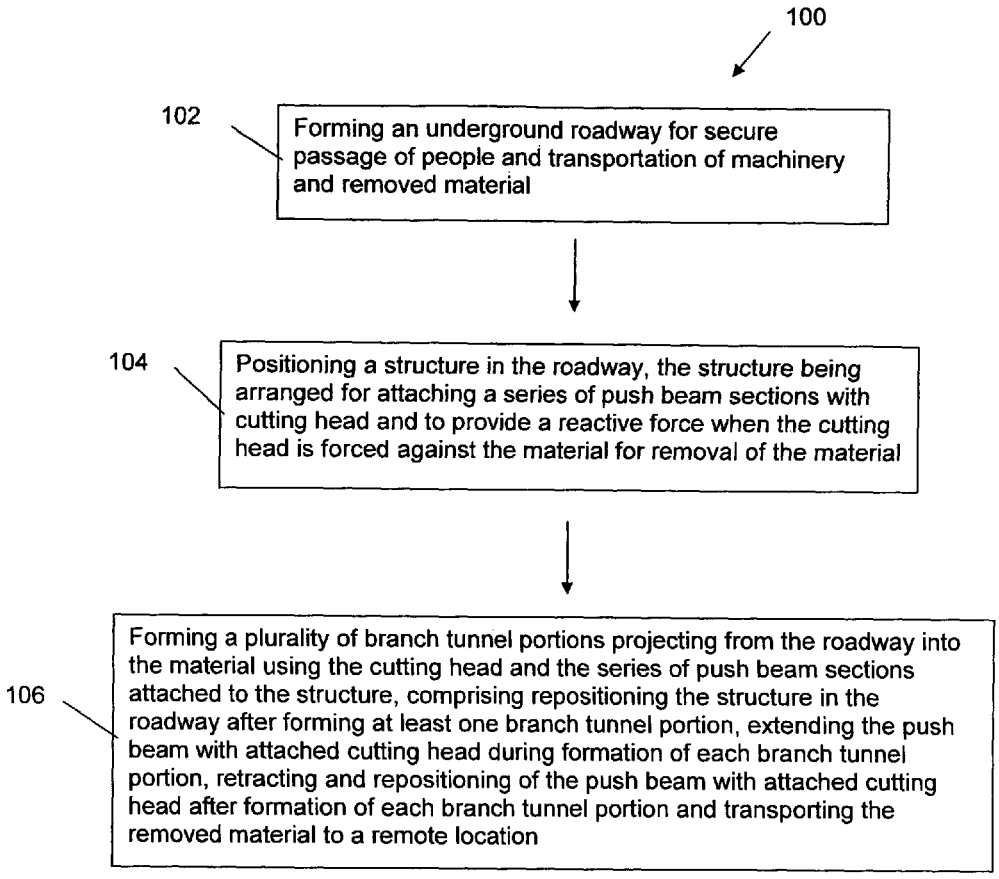
FIG. 1 shows a flow chart illustrating a method for mining a material in an underground environment in accordance with a specific embodiment of the present invention.
Figure 2:
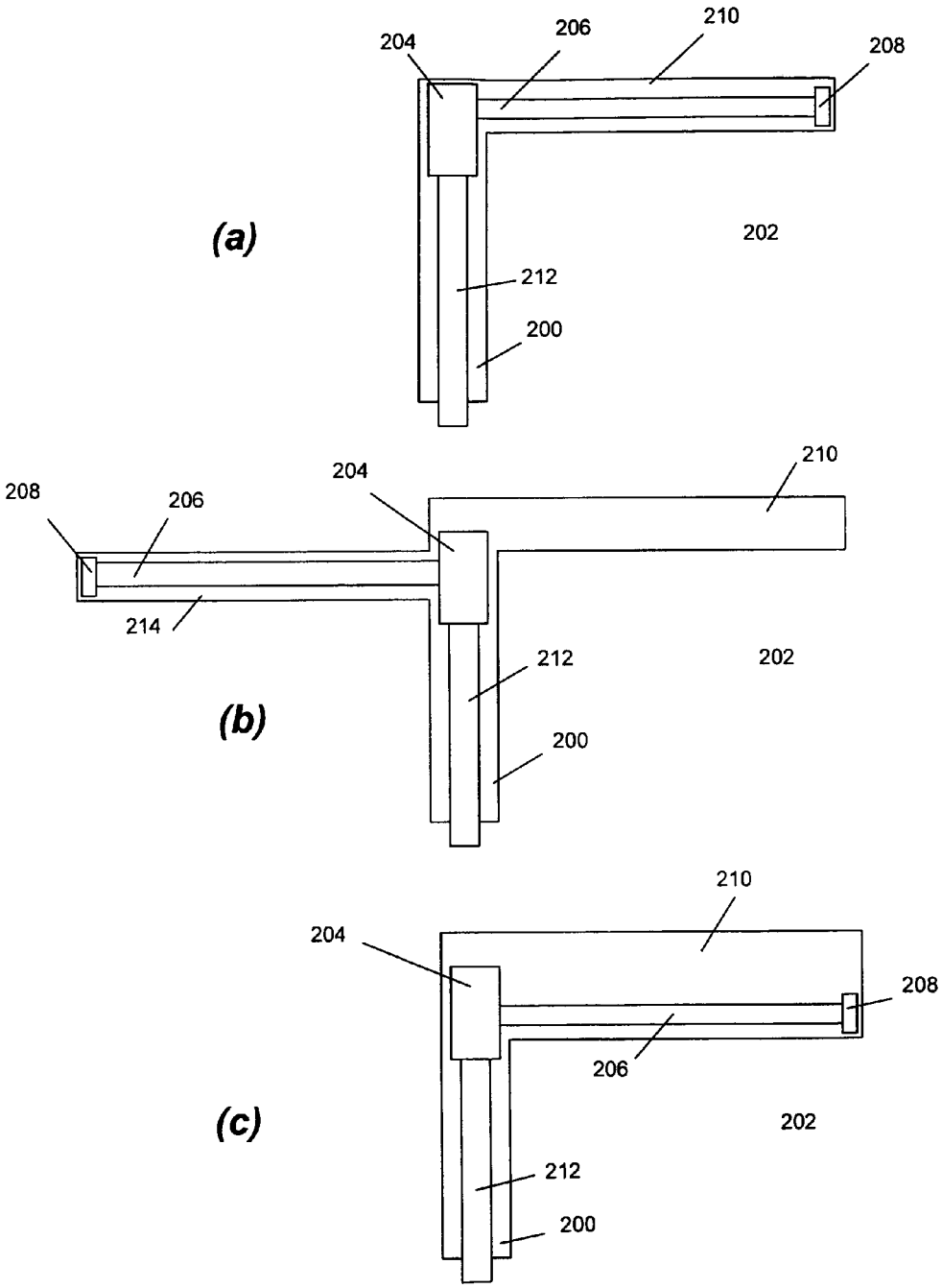
FIGS. 2 (*a*), (*b*) and (*c*) illustrate a method for mining a material in an underground environment in accordance with a specific embodiment of the present invention.
Figure 3:
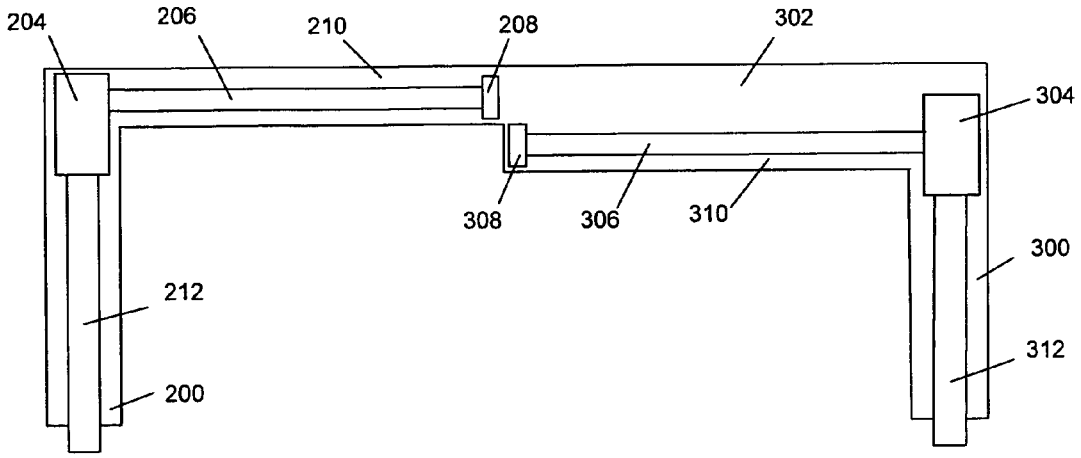
FIG. 3 illustrates a method for mining a material in an underground environment in accordance with another specific embodiment of the present invention.

Referring initially to FIGS. 1 to 3, a method for mining a material in an underground environment in accordance with a specific embodiment of the present invention is now described. For example, the underground environment may be a coal mine and the material may form part of a coal seam of the coal mine. Alternatively, the material may be an ore or may be another type of material that is being mined in an underground environment.

FIG. 1 shows a flow chart illustrating the method for mining a material in an underground environment. The method 100 includes step 102 of forming an underground roadway for the secure passage of people, machinery and transportation removed material. The formed roadway typically has height of 2-4 m and a width of 5-6 m and is secured with bolts and/or other suitable supporting elements.

The method 100 also includes the step 104 of positioning a structure in the roadway. The structure is arranged for attaching a series of rigid beam sections with cutting head and to provide a reactive force when the cutting head is forced against the material for removal of the material.

The method 100 includes step 106 of forming a plurality of branch tunnel portions projecting from the roadway into the material using the cutting head and the series of rigid beam sections attached to the structure. In this embodiment the step 106 comprises repositioning the structure in the roadway after forming at least one branch tunnel portion, extending the rigid beam with attached cutting head during formation of each branch tunnel portion, retracting and repositioning of the series of the rigid beam sections with attached cutting head after formation of each branch tunnel portion and transporting the removed material to a remote location.

The formed branch tunnel portions may have a length of more than 100 m, 200 m or even more than 300 m. The material is mined by forming the branch tunnel portions without the need of people to penetrate into the formed branch tunnel portions.

FIG. 2(*a*) shows schematic illustration of a roadway 200 that was formed in an underground environment 202. A structure 204 is positioned in the roadway 200. Attached to the structure 204 is a series of the rigid beam sections 206 with cutting head 208. The structure 204 is secured in the roadway to provide a reactive force when the series of the rigid beam sections 206 pushes the cutting head 208 against an end portion of a formed branch tunnel portion 210. To provide the reactive force, the structure 204 is secured in the roadway by means of suitable jacks that press against side portions of the roadway 200. Further, a conveyer 212 is positioned in the roadway to convey material removed by the cutting head 208 to a remote location.

In this embodiment, the branch tunnel portion 210 is formed without securing the branch tunnel portion 210 in any way. In particular bolts or any type of supporting rigid members are not provided in the branch tunnel portion 210. Consequently, the branch tunnel portion 210 is not suitable for passage of people. However, the method 100 is conducted so that it is not necessary for people to penetrate into the branch tunnel portion 210. As the branch tunnel portion 210 typically is not secured by bolts or the like, the method 100 has the significant advantage that the material can be mined in a very efficient manner.

The method 100 may comprise the further step of extending the lengths of the series of the rigid beam sections 206 by inserting individual rigid beam sections which may have a length of the order of 2 or 3 m or more. The series of the rigid beam sections 206 typically includes at least one, typically two, auger sections that is arranged to transport the material removed by the cutting head 208 from the cutting head to the structure 204. The conveyer 212 is positioned to receive the removed material from the series rigid beam sections 206 so that the removed material can be transported to a remote location in a convenient manner. The series of the rigid beam sections 206 may have a length of more than 100 m, 200 m, 300 m, 400 m or even more than 500 m. Each individual rigid beam section typically includes one or two auger sections. For example, each rigid beam section may comprise a two parallel auger sections.

A coupling (not shown) is positioned in the structure 204. The coupling is arranged for coupling to the series of the rigid beam sections 206 to the structure 204 and comprises an open bottom portion and a drive for driving the or each series of auger sections of the series of the rigid beam sections 206. The material removed from the cutting head 208 is transported through the series of the rigid beam sections 206 and then drops through the open bottom of the coupling onto the conveyer 212.

The dimension of the branch tunnel portions dependent on requirements, such as a thickness of a seam of the material. For example, each branch tunnel portion may have a width and a height of 2-3 m or more as desired. Once a branch tunnel portion 210 is completed, the series of the rigid beam sections 206 with cutting head 208 is removed. The coupling is arranged so that the series of the rigid beam sections 206 may be attached to a left hand side of the coupling or to a right hand side of the coupling. In the illustrated example the structure 204 is then retracted by a distance that approximately corresponds to the width of the formed branch tunnel portion 210. The cutting head 208 and initially an individual section of the series of the rigid beam sections 206 are then attached to the left hand side of the coupling and a first section of a second branch tunnel portion is formed. Further rigid beam sections are then inserted and a second branch tunnel portion is formed, which is illustrated in FIG. 2 (*b*). FIG. 2 (*b*) shows a formed second branch tunnel portion 214 projecting from the left hand side of the roadway 200. For advancement of the second branch tunnel portion 214 the rigid beam 206 is extended section by section.

FIG. 2 (*c*) illustrates another variation of the described embodiment of the present invention. In this case the series of the rigid beam sections 206 with cutting head 208 was retracted after formation of the tunnel 210 shown in FIG. 1 (*a*) and then the structure 204 was retracted by a distance that approximately corresponds to the width of the formed branch tunnel portion 210. However, in contrast to the example illustrated in FIG. 2 (*b*) the cutting head 208 and series of the rigid beam sections 206 are coupled to the coupling so that a second branch tunnel portion is formed adjacent to the original branch tunnel portion 210 and the resultant branch tunnel has approximately twice the width as the original branch tunnel 210.

A plurality of branch tunnel portions may be formed from a roadway 200 in the described manner so that the material adjacent to the roadway 200 is mined. A person skilled in the art will appreciate that the branch tunnel portions may be formed in any suitable order. Further, a person skilled in the art will appreciate that branch tunnel portions may only be formed to one side of the roadway 200 simultaneously.

FIG. 3 illustrates a further embodiment of the present invention. The left hand side of the illustration shown in FIG. 3 corresponds to that shown in FIG. 2 (*a*). A second roadway 300 was formed in a similar manner. The second roadway 300 is in this example spaced apart from, and parallel to, the roadway 200. FIG. 3 shows a second branch tunnel portion 302 that was formed from the roadway 300 in a direction towards the branch tunnel portion 210 in a manner such that both branch tunnel portions can be joined. The branch tunnel portion 302 has approximately twice the width of the branch tunnel portion 210 and was formed by first forming an upper portion of the portion of the branch tunnel portion 302, then retracting the series of rigid beam sections 306 with the cutting head 308, retracting the structure 304 and forming the lower portion of the branch tunnel portion 302. In this manner the material between the roadways 200 and 300 may be removed.

Figure 4:
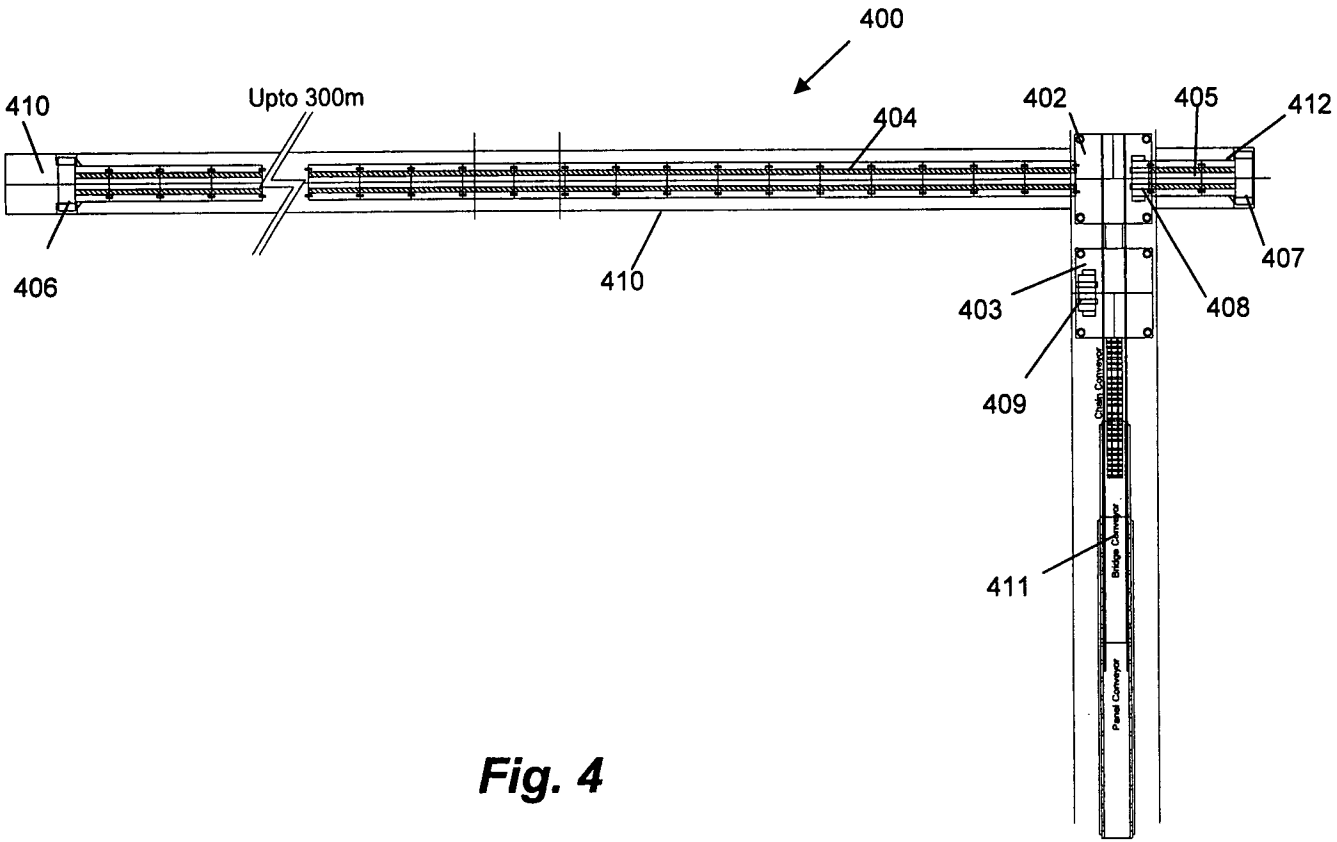
FIG. 4 illustrates an apparatus for mining a material in an underground environment in accordance with a specific embodiment of the present invention.
Figure 5:
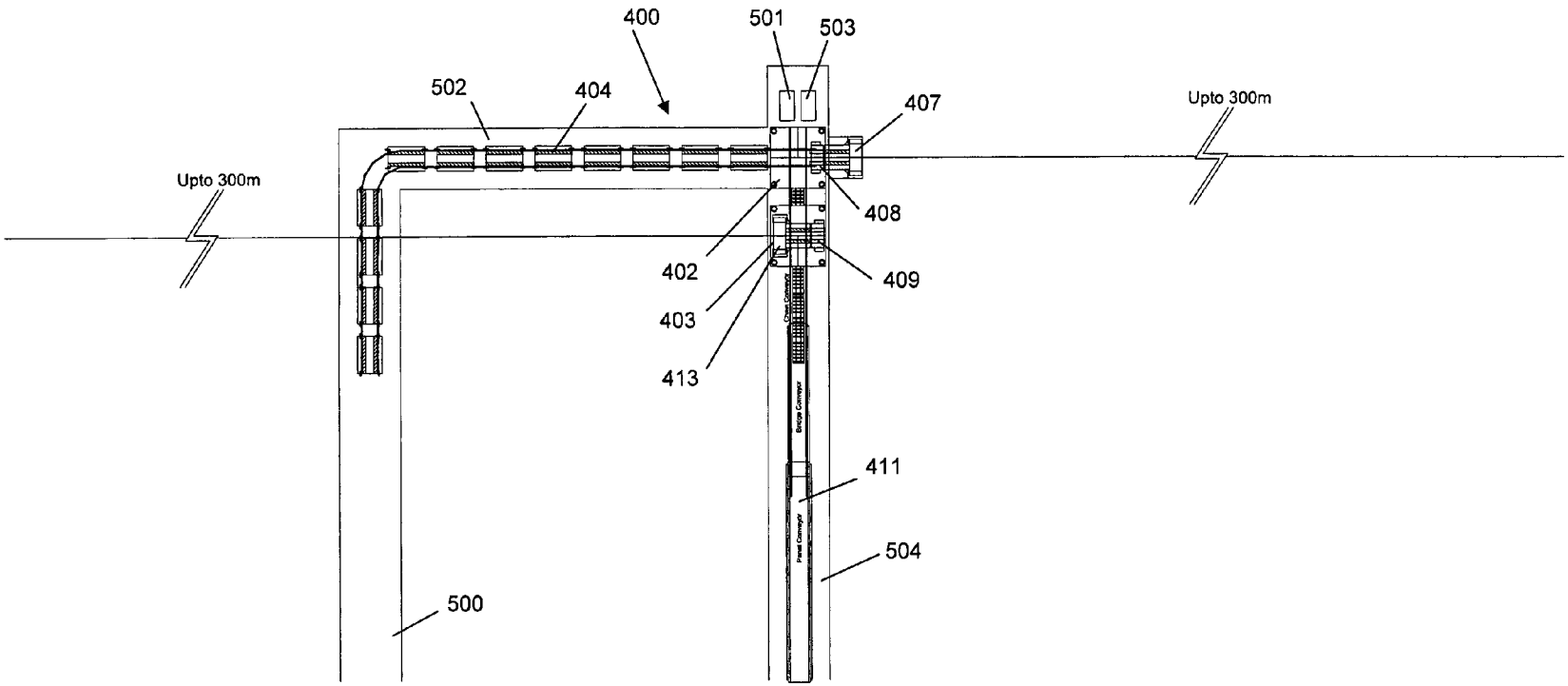
FIGS. 5-8 illustrate a method for mining a material in an underground environment in accordance with a further specific embodiment of the present invention.

FIG. 4 shows a schematic representation of an apparatus for mining a material in an underground environment in accordance with a specific embodiment of the present invention. The apparatus 400 comprises structures 402 and 403, series of rigid beam sections 404 and 405 and cutting heads 406 and 407. In this embodiment the series of the rigid beam sections 404 has a length of approximately 300 m and each individual rigid beam section has a length of approximately 2 m. The series of rigid beam sections 405 has a length of approximately 4 m (or more if the rigid beams are longer).

The series of rigid beam sections 404 and 405 are arranged so that their length can be extended or reduced by insertion or removal of individual rigid beam sections, respectively. Further, the series of the rigid beam sections 404 and 405 comprises a series of augers (not shown) for transporting the material that has been removed by the cutting heads 406 and 407 to the structure 402.

In this example each rigid beam section comprises two parallel auger sections that are positioned within the rigid beam sections and arranged to form two series of the augers.

The apparatus 400 also comprises couplings 408 and 409 to which the series of the rigid beam sections 404 is coupled. The couplings 408 and 409 comprise drives for driving the series of the augers. The couplings 408 and 409 have open bottom portion to which the removed material is transported from a cutting head, such as the cutting head 407 and through which the removed material drops onto a conveyer 411, which comprises a chain conveyor, a bridge conveyor and a panel conveyor. The conveyer 411 conveys the removed material to a remote location.

The couplings 408 and 409 are arranged so that the series of the rigid beam sections may be attached to the coupling from a left hand side or a right hand side.

For formation of the branch tunnel portion 412 initially a first rigid beam section of the series of the rigid beam sections was attached to the coupling 408. During advancement of the branch tunnel portion 412 individual rigid beam sections of the series of rigid beam sections 404 are successively moved from the tunnel portion 410 into the newly formed tunnel portion 412 and inserted into the series of rigid beam sections 405. In this manner the second branch tunnel portion 412 is formed, which may also have a length of 300 m or more.

Once the branch tunnel portion 412 is formed, individual rigid beam sections may be moved to the coupling 409 and a further branch tunnel portion (not shown) may be formed that is substantially parallel to the branch tunnel portion 410.

A person skilled in the art will appreciate that the apparatus 400 may take many different forms. For example, the series of the rigid beam sections 404 may not necessarily project from the structure 402 at a right angle.

Referring now to FIGS. 5-8, a method of mining a material in an underground environment according to a further specific embodiment of the present invention is now described. Initially tunnel portions 500, 502, and 504 are formed and secured to allow safe passage of people and machinery. The apparatus 400, which was described above and is illustrated in FIG. 4, is positioned in the formed tunnel portions 500, 502 and 504 in the manner illustrated in FIG. 5. In this example the apparatus 400 also comprises breaker line supports 501 and 503 and the series of rigid beam sections 404 is positioned in tunnel portions 500 and 502.

An individual rigid beam section is then attached to the coupling 408 and a further tunnel portion to the right hand side of the tunnel portion 504 is formed using cutting head 407. The structure 402 provides a reactive force sufficient so that the cutting head 407 can be forced against the face of the material. The removed material is transported from the cutting head 407 to the conveyer 411, which transports it to a remote location. During advancement of the tunnel portion to the right hand side of the tunnel portion 504 individual rigid beam sections of the series of rigid beam sections 404 are shifted from the branch tunnel portion 504 into the newly formed branch tunnel portion.

Figure 6:
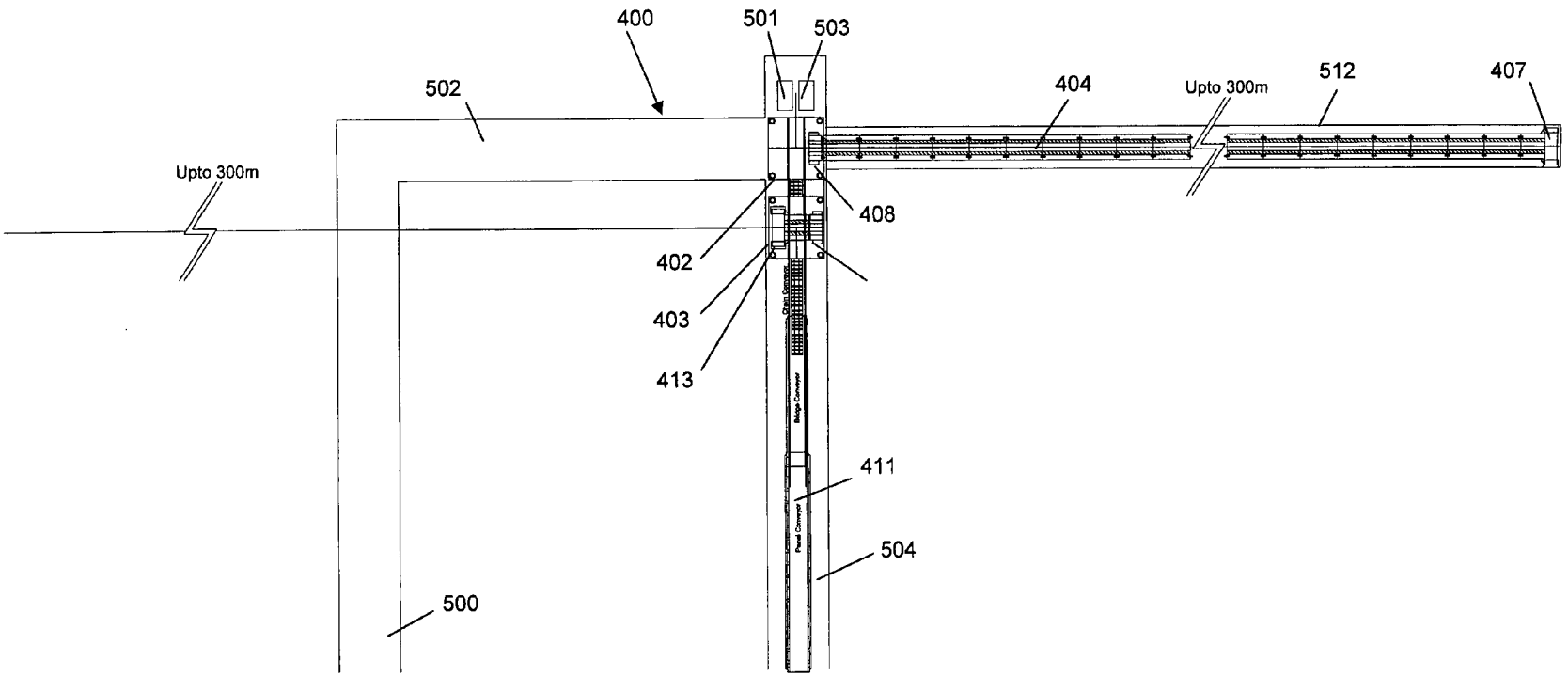

FIG. 6 shows a tunnel portion 512 to the right hand side of the tunnel portion 504 and which was formed in that manner. FIG. 6 shows the apparatus 400 with the series of rigid beams 404 being position in the newly formed branch tunnel portion 512.

Figure 7:
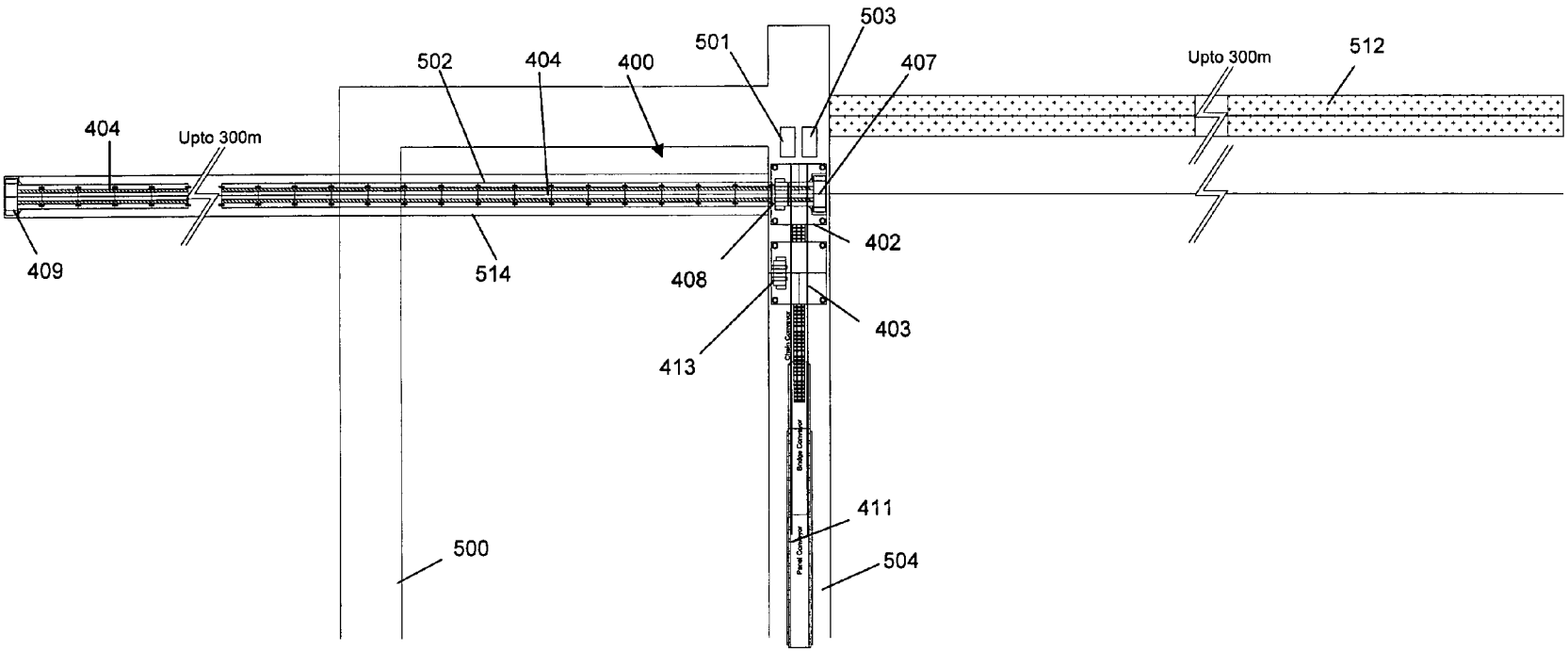

After formation of the tunnel portion 512 the structures 402 and 403 and the conveyer 411 were retracted by a short distance towards an open end of the tunnel portion 504 as illustrated in FIG. 7. Now a further tunnel portion is formed to left hand side of the tunnel portion 504 using the cutting head 409. FIG. 7 shows a newly formed branch tunnel portion 514 extending to the left hand side or the same side of the tunnel portion 504. During formation of the branch tunnel portion 514 individual sections of the series of rigid beams 404 were moved from the branch tunnel portion 512 into the branch tunnel portion 514.

Alternatively, the new branch tunnel portion 514 may also be formed from structure 403 using the cutting head 413.

Figure 8:
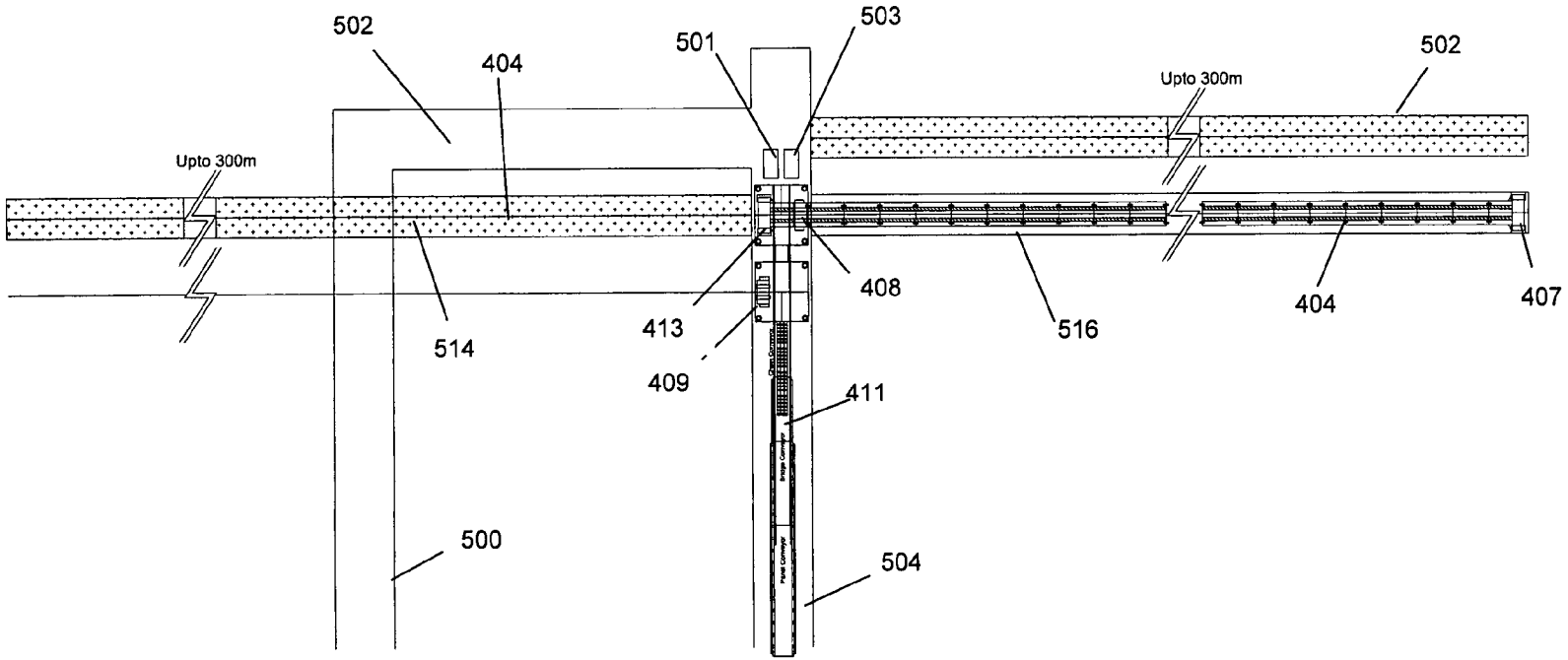

After formation of the tunnel portion 514 a further tunnel portion is formed to the right hand side of the tunnel portion 504. FIG. 8 shows the formed tunnel portion 516. For formation of the tunnel portion 516 individual sections of the series of rigid beams sections 404 were successively moved into the tunnel portion 516.

A person skilled in the art will appreciate that in this convenient manner a large number of tunnel portions may be formed and the material in the underground environment may be mined. Further, a person skilled in the art will appreciate that the method described above and illustrated in FIGS. 5-8 is only one variation of a number of possible examples that are within the scope of the present invention.

Another embodiment of the present invention provides a method of mining a material from a highwall of a mine. The method comprises positioning a structure at the highwall. The structure is arranged for attaching a series of rigid beam sections with a cutting head and to provide a reactive force when the cutting head is forced against the material for removal of the material. The method also provides forming a first tunnel portion using the cutting head and the series of rigid beam sections attached to the structure and retracting rigid beam sections and the cutting head from the first tunnel portion after formation of the first tunnel portion. Further, the method comprises commencing formation of a second tunnel during retracting of the rigid beam sections and the cutting head from the first tunnel portion. In this embodiment rigid beam sections are moved from the first tunnel portion into the second tunnel portion during formation of the second tunnel portion. The first and the second tunnel portions typically are substantially parallel tunnel portions. The method further comprises forming a plurality of additional tunnel portions in a manner such that formation of individual tunnel portions commences during retracting.

Although the invention has been described with reference to particular examples, it will be appreciated by those skilled in the art that the invention may be embodied in many other forms.

The invention claimed is:

1. A method for mining a material in an underground environment, the method comprising the steps of:

locating a structure in or adjacent to an underground roadway so that the structure provides a reactive force when a cutting head is pushed against the material via a series of rigid members coupled to the structure, the structure being arranged for simultaneous coupling of the series of rigid members from at least two directions so that branch tunnel portions can be formed in at least two respective directions, and the underground roadway being suitable for passage of people, and transportation of machinery and removed material;

positioning the cutting head and the series of rigid members so that the structure provides the reactive force when the cutting head is pushed against the material via the series of rigid members; and forming a plurality of branch tunnel portions projecting into the material, comprising:

forming a first branch tunnel portion using the cutting head and the series of rigid members in a first direction; and thereafter forming a second branch tunnel portion and, during formation of the second branch tunnel portion, moving rigid members across the roadway from the first branch tunnel portion into the second branch tunnel portion to extend the series of rigid members in the second branch tunnel portion in a second direction.

2. The method according to claim 1 wherein the first and second branch tunnel portions project from the opposite sides of the roadway.

3. The method according to claim 1 wherein the first and second branch tunnel portions are formed using first and second cutting heads, respectively.

4. The method according to claim 1 wherein the step of locating a structure comprises locating first and second structures in or adjacent an underground roadway so that the first and second structures provide reactive forces when a cutting head is pushed against the material via a series of rigid members coupled to either the first or the second structure.

5. The method according to claim 1 wherein at least one of the formed branch tunnel portions has a length of more than 50 m.

6. The method according to claim 1 wherein the material is mined by forming the branch tunnel portions without the need for people to pass through at least the majority of the length of the formed branch tunnel portions.

7. The method according to claim 1 wherein the branch tunnel portions are formed without positioning any supporting elements or bolts.

8. The method according to claim 1 wherein the material is a part of a coal seam.

9. The method according to claim 1 conducted so that the branch tunnel portions are formed at a speed of more than 10 m per hour.

10. The method according to claim 1 comprising forming a plurality of adjacent branch tunnel portions.

11. The method according to claim 1 wherein the roadway from which the branch tunnel portions project is a first roadway and the method comprises forming a second roadway.

12. The method according to claim 11 comprising removing the material between the first and second roadways by forming a first branch tunnel portion and then forming a second immediately adjacent parallel branch tunnel portion.

13. The method according to claim 11 wherein the second roadway is linked to a side portion of the first roadway in a manner such that the series of rigid members may be moved through a portion of the second roadway towards the first roadway and intersect the first roadway.

14. The method according to claim 1 wherein at least two substantially parallel roadways are formed and the material between the at least two roadways is removed by forming the branch tunnel portions from either one of the at least two roadways.

15. The method according to claim 14 comprising forming a branch tunnel portion from one of the roadways towards an adjacent one of the roadways until the end-portion of another branch tunnel portion, which was formed from the adjacent one of the roadways, is reached.

16. The method according to claim 1 comprising forming the branch tunnel portions so that the formed branch tunnel portions project from either the side-portion of the or each roadway.

17. An apparatus for mining a material in an underground environment, the apparatus comprising:

a series of rigid members having a length of more than 50 m;

a cutting head coupled to an end-portion of the series of rigid members for removing material;

a structure for positioning in or adjacent an underground roadway, the structure being arranged to provide a reactive force when the cutting head is forced against the material for removal of the material via the series of rigid members coupled to the structure for forming a first and a second branch tunnel portion; and a conveyor for conveying removed material to a remote location, wherein the structure is arranged for simultaneous coupling of the series of rigid members from at least two substantially opposite directions so that a first branch tunnel portion can be formed in a first direction, and a second branch tunnel portion can be formed in a second direction that is substantially opposite to the first direction, and wherein the structure is arranged such that during formation of the second tunnel portion, rigid members can be moved across the roadway from the first branch tunnel portion into the second branch tunnel portion to extend the series of rigid members in the second branch tunnel portion.

18. The apparatus of claim 17 wherein each rigid member is a rigid beam section.

19. The apparatus according to claim 17 wherein the series of rigid members comprises rigid members that can be removed or inserted to vary the length of the series of rigid members.

20. The apparatus according to claim 17 wherein the structures comprise open bottom portions positioned over the conveyor.

21. A method of mining a material from a highwall of a mine, the method comprising the steps of:

positioning a structure at the highwall of the mine, the structure being arranged for attaching a series of rigid beam sections with a cutting head and to provide a reactive force when the cutting head is forced against the material for removal of the material, the structure being arranged for simultaneous coupling of the series of rigid beam sections so that tunnel portions can be formed in at least two respective directions;

forming a first tunnel portion in a first direction using the cutting head and the series of rigid beam sections coupled to the structure;

retracting rigid beam sections and the cutting head from the first tunnel portion after formation of the first tunnel portion;

commencing formation of a second tunnel portion in a second direction during retracting of the rigid beam sections and the cutting head from the first tunnel portion; and moving rigid beam sections from the first tunnel portion into the second tunnel portion during formation of the second tunnel portion.

* * * * *